United States Patent [19]

Vandenbrink

[11] 4,241,875

[45] Dec. 30, 1980

[54] FLEXIBLE TRACK

[75] Inventor: Anthonie Vandenbrink, Westmaas, Netherlands

[73] Assignee: Aurora Products Canada Limited, Rexdale, Canada

[21] Appl. No.: 4,800

[22] Filed: Jan. 19, 1979

[51] Int. Cl.[3] ..... A63H 18/12; E01B 23/00

[52] U.S. Cl. ..... 238/10 F; 104/60; 238/10 R

[58] Field of Search ..... 238/10 R, 10 A, 10 B, 238/10 C, 10 E, 10 F, 227, 228, 166; 104/53, 60, 147 A, 149, DIG. 1; 46/1 K, 216, 257, 259; 273/86 B; 406/40; 193/25 E; 198/850, 851

[56] References Cited

U.S. PATENT DOCUMENTS

| | | | |
|---|---|---|---|
| 1,055,253 | 3/1913 | Benzel | 238/227 X |
| 2,675,179 | 4/1954 | Johnson | 238/10 C |
| 2,711,857 | 6/1955 | Vanetzian et al. | 238/10 E |
| 3,243,120 | 3/1966 | Lingard et al. | 238/10 F |
| 4,095,743 | 6/1978 | Birdsall | 238/10 F |
| 4,106,695 | 8/1978 | Carella et al. | 238/10 F |

FOREIGN PATENT DOCUMENTS

| | | | |
|---|---|---|---|
| 489503 | 7/1938 | United Kingdom | 238/10 C |

*Primary Examiner*—Randolph A. Reese

*Attorney, Agent, or Firm*—Blum, Kaplan, Friedman, Silberman & Beran

[57] ABSTRACT

A flexible track consisting of a plurality of track sections extending laterally of the track, each track section being pivotably coupled to the adjacent track section in a central region, viewed laterally, thereof. The respective facing portions of each pair of adjacent track sections are shaped so as to define an essentially tapered gap on each side of the central region extending inwardly from the lateral periphery of each track section, the gap being widest at said lateral periphery. The top surface of each track section is formed of at least one portion projecting longitudinally of said track on one side thereof and a recess on the other side thereof shaped to receive the longitudinally projecting portion of the adjacent track section, the essentially tapered gap being defined at least in part between the projecting portions and the recesses. The top surface of each section is formed with at least one longitudinally extending slot aligned with the corresponding slot of the other track sections, an electrically conductive element capable of longitudinal extension and contraction during relative pivoting of adjacent track sections extends through the aligned slots and across the gaps.

17 Claims, 12 Drawing Figures

FIG. 1
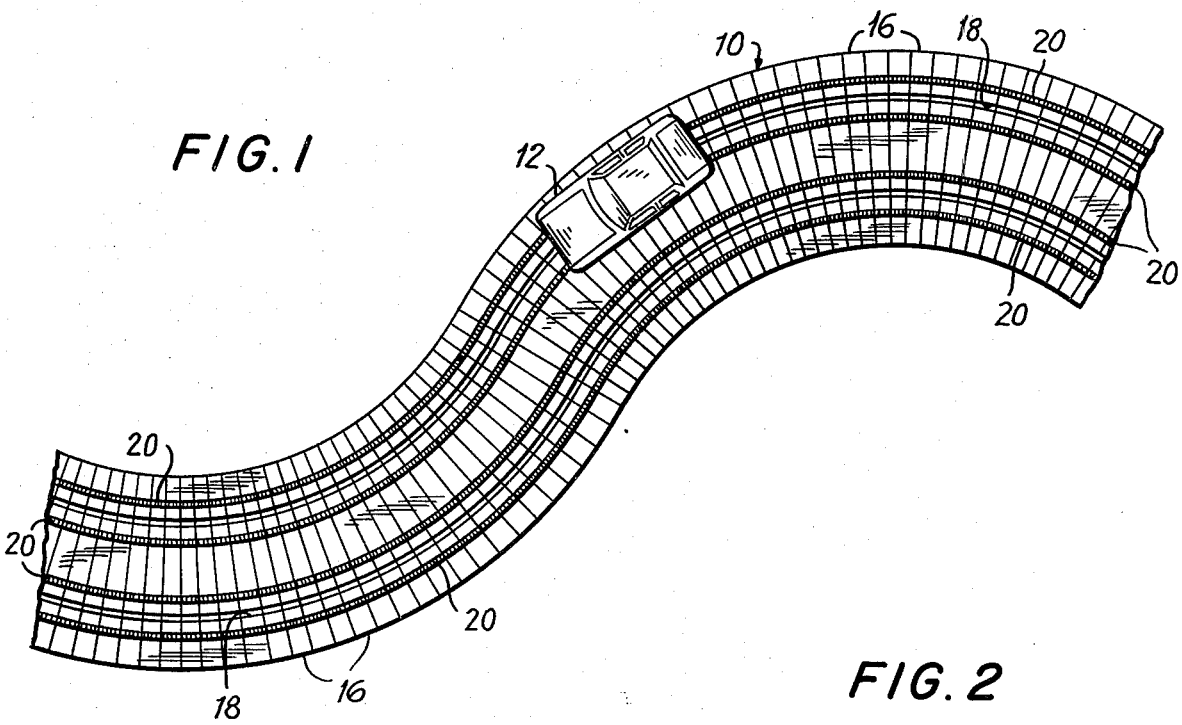
FIG. 2
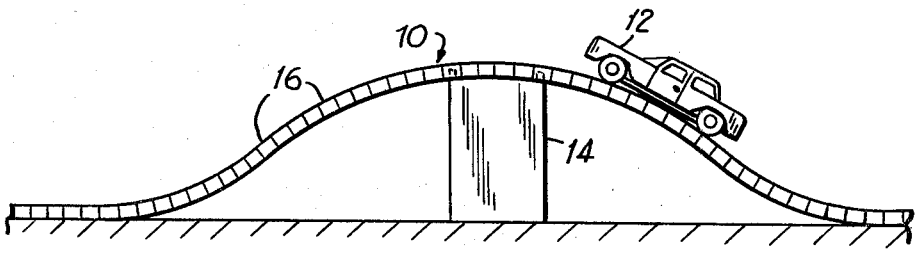
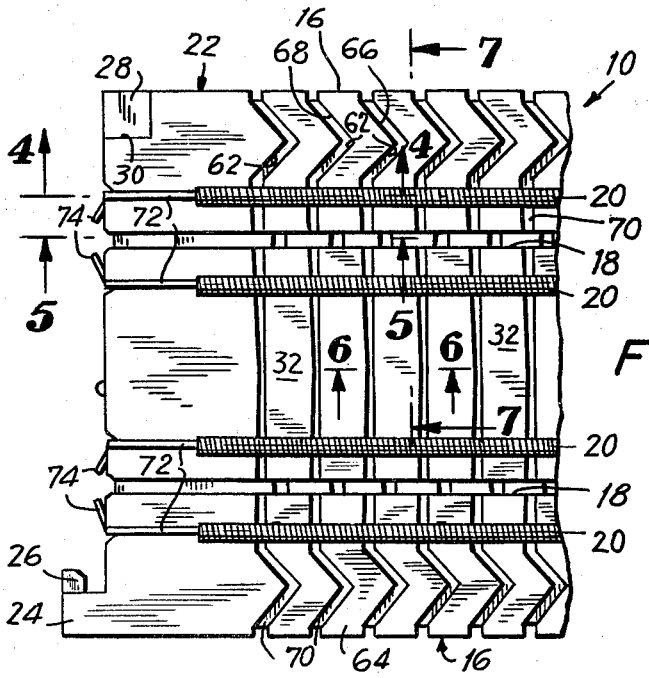
FIG. 3

FLEXIBLE TRACK

BACKGROUND OF THE INVENTION

This invention relates generally to flexible tracks of a type useful in conjunction with toy vehicles, in particular, in connection with flexible track utilizable in toy road racing sets wherein each vehicle is powered by a pair of brushes which engage a pair of electrical conductors disposed in the top surface of the track for the energization thereof. One particular type of such racing sets are referred to as slot car sets wherein the track is provided with a longitudinally extending slot in the top surface thereof and the vehicle is provided with a projection for receipt in the slot to guide the vehicle along a prescribed path so as to insure registration of the brushes with the conductors. The track generally in use is made up of a multiplicity of interconnected rigid track sections shaped to define the desired vertical and horizontal curvatures. Such track sections limit the play value of the racing set in that only limited configurations of the tracks may be assembled with each group of track sections due to inflexibility of the respective track sections.

U.S. Pat. No. 4,095,743 teaches a flexible track formed from a plurality of track sections pivotably coupled to each other at a central region thereof. It has been found that while the flexible track disclosed in that patent solves some of the problems found in the prior art flexible track arrangements, further improvements are required in order to provide the desired road racing characteristics and ease of manufacture. Specifically, in the straight configuration, the patent teaches a uniform gap between the portion of adjacent track sections in the region of the slots and electrical conductors. The wheels of toy vehicles passing over such uniform gaps tend to ride in and out of the gaps, thereby increasing the resistance to rapid travel of the vehicle, and causing undesired vibration and noise. Further, it is desirable to provide a flexible track capable not only of defining curves but also banks and hills and the patent contains no teaching as to how to achieve this result.

By the arrangement of the instant invention, the defects in the prior art have been overcome and a commercially feasible flexible track providing enhanced play value to the user is provided.

SUMMARY OF THE INVENTION

Generally speaking, in accordance with the invention, a flexible track for toy vehicles is provided which includes a plurality of track sections extending laterally of said track, each track section being coupled to the adjacent track section by coupling means permitting at least relative pivotal displacement of adjacent track sections about an axis of pivoting extending substantially normally to the track top surface.

The respective facing portions of each pair of adjacent track sections are shaped so as to define a gap therebetween when said flexible track is aligned in a substantially straight configuration when viewed longitudinally. The respective top surfaces of said track sections define a path for said toy vehicles, the respective top surfaces of said track sections being formed to minimize the interaction between the wheels of said toy vehicles and said gap.

Specifically, the top surfaces of said track sections may be shaped to define an essentially tapered gap extending inwardly from a lateral periphery of the track spaced from said coupling means, said gap being widest at said lateral periphery. The path of said toy vehicle being aligned on said top surfaces of said track section so that at least one wheel of said vehicle would normally travel in the region of the top surfaces in registration with the narrower portions of said gap.

The respective facing portions of each pair of adjacent track sections may be formed of at least one portion projecting longitudinally of said track on one side thereof and a recess on the other side thereof shaped to receive the longitudinally projecting portion of the adjacent track section, the gap being defined at least in part between said projecting and recessed portions, said projecting portions being positioned in registration with the path of at least one wheel of said toy vehicle, whereby said wheel engages the top surface of one of the two adjacent track sections while substantially traversing said gap.

Said coupling means may be positioned in a central region, viewed laterally, of adjacent track sections, the respective facing portions of each pair of adjacent track sections being shaped to define a gap on each side of said central region extending inwardly from the lateral periphery of each track section and limiting relative pivotal displacement of adjacent track sections. The respective gaps may each be essentially tapered, being widest at the lateral periphery of said track. The coupling means may include snap-in coupling means including a socket means on one of each pair of adjacent track sections and a projecting means on the other of each pair of adjacent track sections, said socket means and projecting means being shaped to permit the pivotable relative displacement of adjacent track sections. Said coupling means may be further adapted to permit tilting of adjacent track sections relative to each other so that the planes of the respective top surfaces thereof define a small angle relative to each other. For this purpose, said socket means and projecting means may be shaped with a predetermined clearance therebetween to permit said relative tilting displacement.

The respective top surfaces of said track sections may be formed with at least one longitudinally extending aligned slot for receiving an electrical conductor therein. Said electrical conductor is adapted for longitudinal extension and contraction at least in the region thereof bridging said gap. Preferably a pair of such aligned slots and electrical conductors are provided. Said electrical conductors may be formed of coil springs of a conductive material. Said top surface of each of said track sections may be formed with a further aligned slot for guiding a toy vehicle along a path on said track. The portion of one of each pair of adjacent track sections facing said adjacent track section is provided with a longitudinally extending projection at least in the region on opposed sides of said guide slots below the top surface of said track section for defining the slot for guiding purposes in said gap, the facing surface of the other of said pair of track sections being formed with a recess shaped to receive said last-mentioned projecting portion while maintaining said gap.

Accordingly, it is an object of this invention to provide a flexible track formed of discrete track sections pivotably coupled to permit flexible orientation thereof while maximizing the smoothness of the track surface as seen by the vehicle wheels.

Another object of the invention is to provide a flexible track having enhanced play value, being capable of forming curves, hills and banks.

A further object of the invention is to provide a flexible track particularly adapted for toy vehicles of the slot car type including electrical conductors and guide slots which permit the desired vehicle performance.

Still other objects and advantages of the invention will in part be obvious and will in part be apparent from the specification and drawings.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a diagrammatical top plan view of a length of flexible track in accordance with the invention oriented in an S-shape and having a toy vehicle disposed thereon;

FIG. 2 is a diagrammatical side elevational view of a length of flexible track in accordance with the invention disposed to define a hill and having a toy vehicle thereon;

FIG. 3 is a fragmentary top plan view of a length of flexible track in accordance with the invention;

DESCRIPTION OF THE PREFERRED EMBODIMENTS

Figure 4:
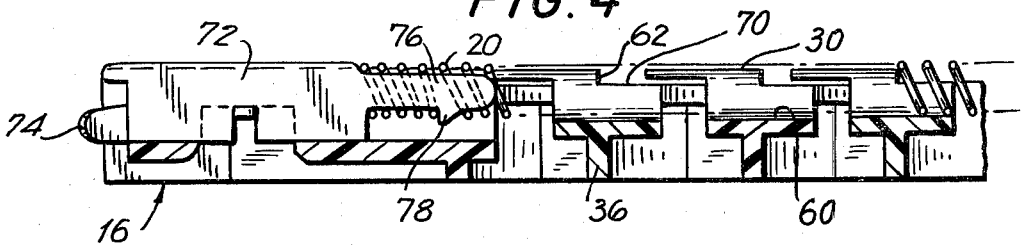
FIGS. 4, 5, 6 and 7 are sectional views taken respectively along lines 4—4, 5—5, 6—6 and 7—7 of FIG. 3.
Figure 5:
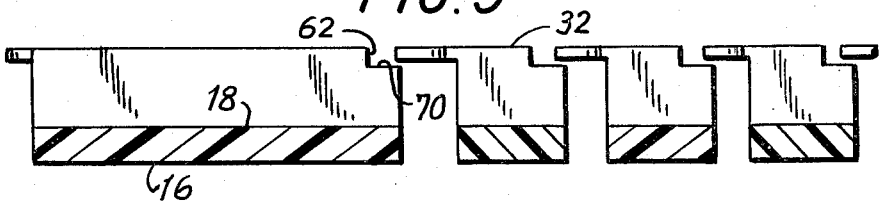

Referring now to FIG. 1, a length of flexible track 10 in accordance with the invention is depicted oriented in an S-shape. The embodiment of the track depicted is adapted for slot-car racing having two side-by-side parallel paths on the top surface thereof for the guided passage of a vehicle as exemplified by car 12. FIG. 2 depicts a length of flexible track 10 in accordance with the invention aligned in a "hill" orientation supported, by way of example, by a support 14. As will become more apparent below, the flexible track 10 in accordance with the invention is formed of a plurality of track sections 16 coupled together so as to provide pivoting of adjacent track sections in the plane of the top surface of the track as exemplified by the S-shape of FIG. 1 and relative tilting to define a small angle between the respective top surfaces of adjacent track sections to define the "hill" configuration of FIG. 2. While the relative pivoting and tilting between each adjacent pair of track sections is relatively small, the cumulative effect of the plurality of track segments each pivoting and tilting permits the creation of a wide variety of track orientations enhancing the play value of the track in accordance with the invention. By combining tilting and pivotable displacement the length of track 10 can be oriented in a bank configuration.

For the purposes of slot-car racing, track 10 is provided with two longitudinally extending guide slots 18, one defining each path. On opposite sides of each slot are a pair of electrical conductors disposed in the surface of the track for cooperating with brushes (not shown) on car 12 for providing power thereto.

Referring now to FIGS. 3-12, a fragmentary length of track 10 is depicted including a plurality of track sections 16 coupled at one end to a connecting section 22. One connecting section 22 would be provided on each end of the length of track 10 to permit connection thereof with other lengths of track, either of the flexible type in accordance with the invention or of conventional rigid configuration. The right-most portion as viewed in FIG. 3 of connecting section 22, facing the adjacent track section 16 is shaped essentially identically as the right-most portion as viewed in FIG. 3 of each of said track sections 16, as will be more particularly described below. The left-most portion of connecting section 22 is designed to effect coupling with other track sections and may be disposed in any of the well-known prior art coupling configurations. The particular coupling configuration illustrated in the drawings, by way of example, consists of a projection 24 on one lateral side of connecting section 22 having a centrally projecting finger 26 formed therewith, and a recess 28 having on opening in wall 30 thereof. The track to which the length of track 10 is to be connected is provided with a projection 24 and recess 28 oriented in a mirror image to the orientation illustrated in FIG. 3, the second projection 24 being received in recess 28 and finger 26 passing through the hole in wall 30 to effect coupling.

Figure 6:
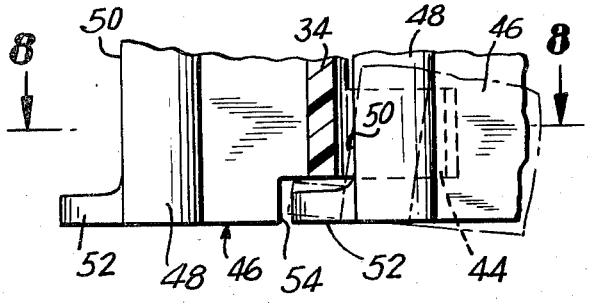
Figure 8:
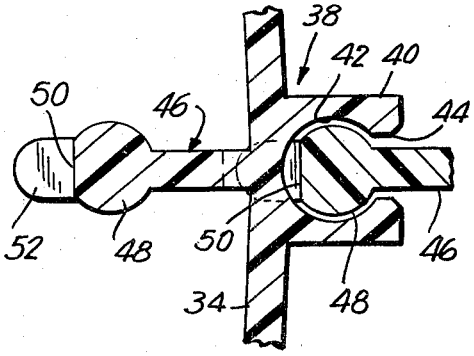
FIG. 8 is a sectional view taken along lines 8—8 of FIG. 6.
Figure 7:
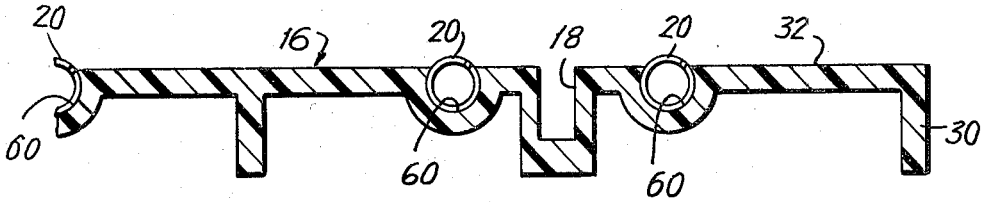

Each track section 16 is provided with a top wall defining a top surface 32 which serves as a path for the wheels of the vehicles. Said top wall is supported by a downwardly projecting rib 34 which extends substantially the width of each track section between the peripheral sides thereof, the end of rib 34 joining a downwardly projecting wall 36 on each lateral side of the track section. As more particularly shown in FIG. 8, central of rib 34 and molded integral therewith is a coupling assembly 38. Coupling assembly 38 includes a socket member 40 projecting longitudinally of the track toward one adjacent track section and formed with an essentially cylindrical socket 42 having an opening 44 providing access thereto. Projecting from the opposite side of rib 34 is a projection 46 having an essentially cylindrical portion 48 adjacent the end thereof, the cylindrical portion of the projection 46 having a flattened surface 50 formed therein. A tab projects longitudinally from the bottom of flattened surface 50. The material of socket member 40 is sufficiently resilient to permit the snap-in of the cylindrical portion 48 of the projection 46 of the adjacent track section to define a coupling pivotable along an axis extending substantially perpendicular to top surface 32. Socket 42 and cylindrical portion 48 are dimensioned to provide a clearance therebetween as shown in FIGS. 6 and 8, such clearance, acting in conjunction with flattened surface 50 permitting the relative tilting of adjacent track sections so that the top surface 32 of adjacent track sections define a small angle with each other. The relative tilting is illustrated by the chain-line alternate showing in FIG. 6. Also as more particularly shown in FIG. 6, the lower portion of rib 34 and a portion of projection 46 is formed with a notch which receives tab 52, the tab serving to limit the relative vertical displacement and tilting displacement of adjacent track sections. Each track section 16 is provided with a longitudinally extending guide slot 18 in top surface 32 on each side of coupling assembly 38 defining a pair of paths for toy vehicles as described above. On opposed sides of each slot 18 is a channel 60 of arcuate cross-section. Each arcuate channel 60 receives an electrical conductor 20 in the form of a coil spring so that a portion of the coil spring projects above top surface 32 for engagement by a brush of a vehicle.

As more particularly shown in FIG. 3, when track 10 is aligned in a straight configuration the facing portions of adjacent track sections define a tapered gap 62 on each side of the coupling assembly 38. The gap is at its narrowest in the central region of the track sections defined by the coupling assembly and gradually increases in width, reaching a maximum at the lateral periphery of the track sections in the regions of walls 36. The width of the gap 62 defines the limit of relative pivotable displacement between adjacent track sections. This limit of displacement is more particularly illustrated in FIG. 10 which shows an adjacent pair of track section 16 pivotably displaced relative to each other to the maximum extent.

Also as more particularly shown in FIG. 3, the top surface 32 of each track section has a chevron-shaped region 64 on each side thereof intermediate the side periphery of the track section and the adjacent electrical conductor 20. Each chevron-shaped section is defined by a longitudinally projecting portion 66 on the right side as viewed in FIG. 3 of top surface 32 and a correspondingly shaped recess 68 on the left side of top surface 32 as viewed in FIG. 3. In this manner, each projection 66 nests in a recess 68 of the adjacent track section and the tapered gap 62 extends between and follows the path of projection 66 and recess 68.

By the foregoing configuration of groove 62 the ride experienced by the vehicle is substantially smooth, notwithstanding the fact that a segmented track characterized by gap 62 in the top surface of the track is provided. This results from the fact that each pair of wheels of the vehicle ride respectively on opposed sides of the pair of electrical conductors 20. The inner-most wheel of each pair of wheels rides on the thinnest part of tapered gap 62, and therefore sees only the smallest possible gap. The outer-most wheel of each pair of wheels rides over the widest gap but in the region of chevron-shaped portions 64 of top wall 32. As more particularly illustrated in FIGS. 10 and 11, if the wheel is of sufficient width, it will always ride on at least some flat portion of one of the two adjacent track sections and will never fall into the gap 62.

Each track section 16 is further formed with a longitudinally projecting ledge 70 extending to the right as viewed in FIGS. 3 and 9 from a portion of rib 34 below the top wall defining top surface 32. Each ledge 70 aids in the support of the adjacent track section and preferably underlies the wall defining top surface 32 even at the position of maximum pivoting as illustrated in FIG. 10.

Slot 18 continues into ledge 70 so that the ledge provides the guiding effect to the projection (not shown) on the vehicle even in gap 62 so that the vehicle is smoothly guided along the track.

Figure 9:
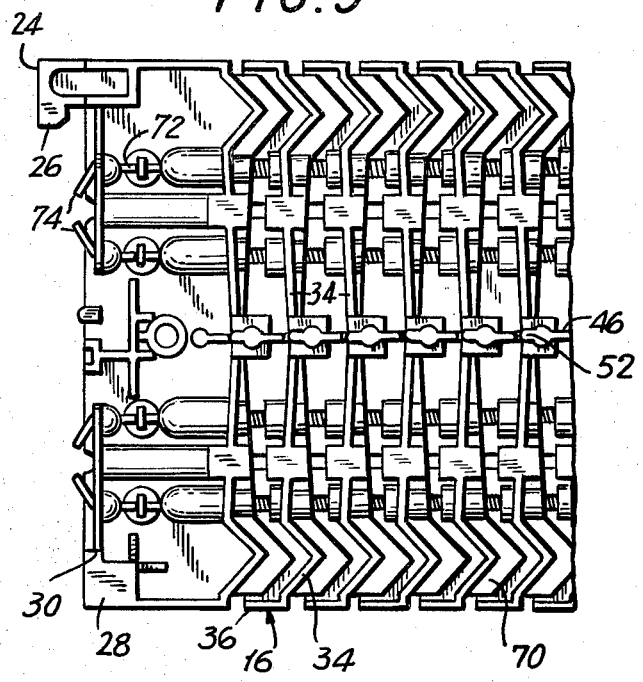
FIG. 9 is a fragmentary bottom plan view of a length of flexible track of FIG. 3.
Figure 10:
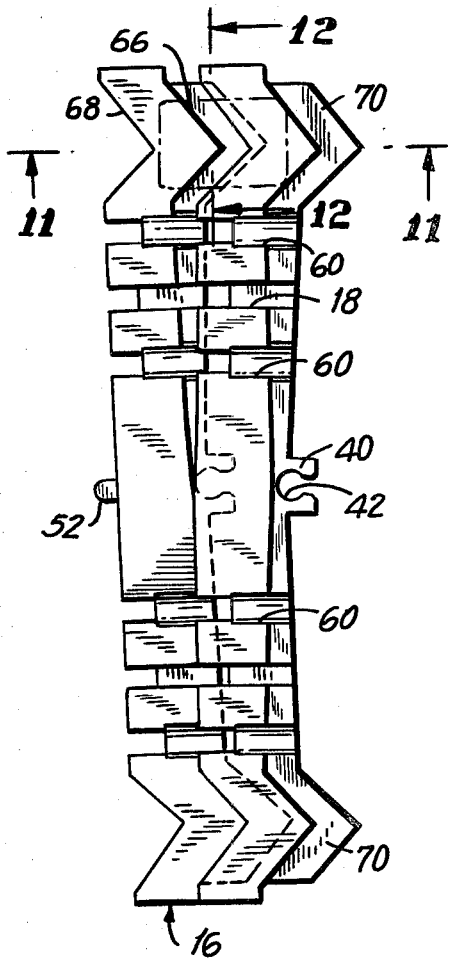
FIG. 10 is a top plan view of two track sections in accordance with the invention illustrating the relative pivoting thereof with the electrical conductor removed.
Figure 11:
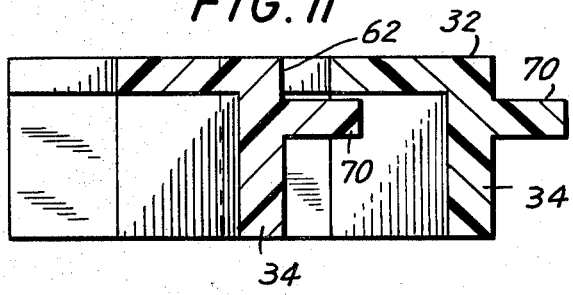
FIGS. 11 and 12 are sectional views taken along lines 11—11 and 12—12 of FIG. 10.
Figure 12:
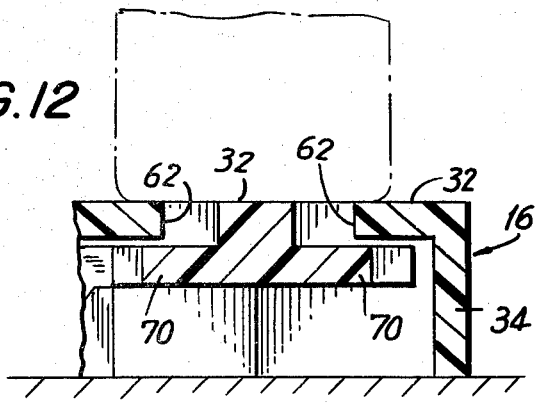

Referring to FIGS. 3, 4 and 9, electrical connection between the end of the coil spring defining electrical conductor 20 and the adjacent track is by means of a contact member 72 formed of a conductive material. One end of contact member 72 is formed with an inclined spring finger 74 which makes electrical contact with a corresponding spring finger of the length of track to which it is coupled. The inner end of contact member 72 is formed with a projecting finger 76 about which the end of the coil spring of electrical conductor 20 extends. A downwardly projecting tooth 78 extends from finger 76 and engages between two coils of spring 20 to insure electrical contact therebetween.

While the embodiment depicted in the drawings is a slot-car track adapted for a pair of slot-car paths, the same principles could be readily applied to a single slot-car path pivotably coupled on one side of the track, and therefore only pivotably displaceable in one direction. Similarly, by the provision of suitable upstanding walls on the periphery of the top surface 32, a slotless flexible track can be provided. While a coil spring electrical conductor is depicted, other forms of electrical conductors capable of extension and contraction in the gap may be provided as exemplified by the sliding electrical conductors disclosed in U.S. Pat. No. 4,095,743.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A flexible track for wheeled toy vehicles having at least one pair of laterally spaced wheels including a plurality of separate track sections extending laterally of said track and each having a top surface defining a path for said toy vehicles; and coupling means pivotably coupling adjacent track sections, said coupling means permitting at least relative pivotal displacement of adjacent track sections about an axis of pivoting extending substantially normally to the track top surface, each of said track sections being formed with portions facing the adjacent track section shaped so as to define a gap therebetween extending between said coupling means and a lateral periphery of said track when said track is aligned in a substantially straight configuration when viewed longitudinally, the top surfaces of said portions of said track sections being shaped to define an essentially tapered gap extending from the lateral periphery of said track to at least the region of said coupling means, said gap being widest at said lateral periphery, the path of a toy vehicle on said top surfaces of said track section being aligned so that at least the one wheel of said pair of laterally spaced wheels farthest from the lateral periphery of the track would normally travel in the region of the top surfaces in registration with the relatively narrower portions of said gap whereby interaction between said at least one wheel of each of said toy vehicles and said gap as might cause vibration and reduction in the speed of the vehicles is minimized.

2. The flexible track of claim 1 wherein said coupling means is positioned in a central region of said track section as viewed laterally on said track section, each of said track sections being formed to define two of said essentially tapered gaps each extending from a lateral periphery of said track to the region of said coupling means.

3. The flexible track of claim 2 including means defining two paths on said top surfaces of said track section, one on each side viewed laterally of said central region containing said coupling means.

4. The flexible track as claimed in claim 1 wherein the facing portions of the top surfaces of each pair of adjacent track sections defining said gap are formed in relatively wider portions of said gap with at least one portion projecting longitudinally of said track on one longitudinal side thereof and with a recess on the other longitudinal side thereof shaped to receive said longitudinally projecting portion of the adjacent track section, said gap being defined at least in part between said projecting and recessed portions, a portion of the periphery of said projecting portions extending at least in part longitudinally of said track being positioned in registration with the path of at least the other of said pair of laterally spaced wheels closest to the lateral periphery of the track, whereby said other wheel engages the top surface of at least one of said two adjacent track sections while substantially traversing said gap.

5. A flexible track for wheeled toy vehicles having at least one pair of laterally spaced wheels including a plurality of separate track sections extending laterally of said track and each having a top surface; and coupling means pivotably coupling adjacent track sections, said coupling means permitting at least relative pivotal displacement of adjacent track sections about an axis of pivoting extending substantially normally to the track top surface, said track top surface defining at least one path for said toy vehicles intermediate a lateral periphery of said track and said coupling means, each of said track sections being formed with portions facing the adjacent track section shaped so as to define a gap therebetween extending between said coupling means and said lateral periphery of said track when said track is aligned in a substantially straight configuration when viewed longitudinally, the facing portions of the top surfaces of each pair of adjacent track sections defining said gap being formed with at least one portion projecting longitudinally of said track on one longitudinally side thereof and with a recess on the other longitudinal side thereof shaped to receive said longitudinally projecting portion of the adjacent track section, said gap being defined at least in part between said projecting and recessed portions, a portion of the periphery of said projecting portions extending at least in part longitudinally of said track being positioned in registration with the path of at least the one wheel of said pair of laterally spaced wheels closest to the lateral periphery of the track, whereby said one wheel engages the top surface of at least one of said two adjacent track sections while substantially traversing said gap, thereby minimizing interaction between the wheels of said toy vehicles and said gap as might cause vibration and reduction in the speed of the vehicles.

6. The flexible track of claim 5 wherein said top surfaces of said portion of said track section are shaped to define an essentially tapered gap extending from the lateral periphery of said track to at least the region of said coupling means, said gap being widest at said lateral periphery, the path of a toy vehicle on said top surfaces of said track section being aligned so that at least the other wheel of said pair of laterally spaced wheels farthest from the lateral periphery of the track would normally travel in the region of the top surfaces in registration with the relatively narrower portions of said gap.

7. The flexible track as recited in claims 4 or 5, wherein said coupling means is located in a central region of said track section as viewed laterally, at least one of said projecting and recessed portions being located in a region adjacent each peripheral side of said track section.

8. The flexible track as recited in claim 7, including means for defining two paths for said vehicles, one path on each side of said central region including said coupling means, said paths being positioned so that the wheels of the vehicles closest to the adjacent side periphery of said track are in substantial registration with said projecting and recessed portions for riding thereon.

9. The flexible track as recited in claims 4 or 5, wherein the top surface of each of said track sections in the region of said projecting and recessed portions substantially define a chevron-shape.

10. A flexible track for wheeled toy vehicles having at least one pair of laterally spaced wheels including a plurality of separate track sections extending laterally of said track and each having a top surface; coupling means pivotably coupling adjacent track sections, said coupling means permitting at least relative pivotal displacement of adjacent track sections about an axis of pivoting extending substantially normally to the track top surface, said track top surface defining at least one path for said toy vehicles intermediate a lateral periphery of said track and said coupling means, each of said track sections being formed with portions facing the adjacent track section shaped so as to define a gap therebetween extending between said coupling means and a lateral periphery of said track when said track is aligned in a substantially straight configuration when viewed longitudinally, the width of at least portions of said gap increasing as adjacent track sections are relatively pivoted in one direction; and longitudinally projecting shelf means positioned below the top surface of the track section, said longitudinally projecting shelf means extending laterally over a major portion of the gap and projecting longitudinally a sufficient distance to provide support for the adjacent track section over all widths of said gap.

11. A flexible track as recited in claims 1, 4, 5 or 10, wherein said coupling means is adapted to permit tilting of adjacent track sections relative to each other so that the planes of the respective top surfaces thereof define a small angle relative to each other.

12. The flexible track of claim 11, wherein said coupling means is a snap-in coupling means including socket means and projecting means, said socket means having a substantially cylindrically shaped socket, and including clearance between said projecting means and said socket to permit said tilting displacement.

13. A flexible track for wheeled toy vehicles including a plurality of separate track sections extending laterally of said track and each having a top surface defining a path for said toy vehicles; and coupling means pivotably coupling adjacent track sections, said coupling means permitting at least relative pivotal displacement of adjacent track sections about an axis of pivoting extending substantially normally to the track top surface, each of said track sections being formed with portions facing the adjacent track section shaped so as to define a gap therebetween extending between said coupling means and a lateral periphery of said track when said track is aligned in a substantially straight configuration when viewed longitudinally, each of said track sections being shaped to minimize interaction between the wheels of said toy vehicles and said gap as might cause vibration and reduction in the speed of the vehicles, said coupling means being adapted to permit tilting of adjacent track sections relative to each other so that the planes of the respective top surfaces thereof define a small angle relative to each other, said coupling means being a snap-in coupling means including socket means and projecting means, said socket means having a substantially cylindrically shaped socket, and including clearance between said projecting means and said socket to permit said tilting displacement.

14. The flexible track as recited in claims 1, 4, 5 or 13, wherein the respective top surfaces of said track sections are each formed with at least one longitudinally extending aligned slot for guiding said vehicle, and including a further longitudinally projecting portion on one longitudinal side of said track section at least in the region on opposed sides of said guide slot and positioned below the top surface of said track section for defining the slot for guiding purposes in said gap.

15. A flexible track as recited in claim 14, wherein said further projecting portion defines a shelf capable of providing support for the adjacent track section.

16. The flexible track as claimed in claims 1, 4, 5 or 13, wherein the width of at least portions of said gap increases as adjacent track sections are relatively pivoted in one direction, and including longitudinally projecting shelf means positioned below the top surface of the track section, said longitudinally projecting shelf means extending laterally over a major portion of the gap and projecting longitudinally a sufficient distance to provide support for the adjacent track section over all widths of said gap.

17. The flexible track of claim 10, wherein said coupling means is positioned in a central region of said track sections as viewed laterally on said track sections, each of said track sections being formed to define two of said gaps each extending from a lateral periphery of said track to the region of said coupling means, one of said longitudinally projecting shelf means being positioned below the top surface of the track section and projecting across each of said gaps.

* * * * *